US008414551B2

(12) United States Patent
Siniawski et al.

(10) Patent No.: US 8,414,551 B2
(45) Date of Patent: Apr. 9, 2013

(54) PERSONAL FEMININE HYGIENE DEVICE

(75) Inventors: Allysa Siniawski, Lee, MA (US); Evan Morowitz, Lenox, MA (US)

(73) Assignee: Better Ways for Woman, Lenox, MA (US)

( * ) Notice: Subject to any disclaimer, the term of this patent is extended or adjusted under 35 U.S.C. 154(b) by 0 days.

(21) Appl. No.: 13/014,442

(22) Filed: Jan. 26, 2011

(65) Prior Publication Data

US 2011/0264060 A1 Oct. 27, 2011

Related U.S. Application Data

(60) Provisional application No. 61/298,334, filed on Jan. 26, 2010.

(51) Int. Cl.
*A61M 1/00* (2006.01)
*A61F 13/15* (2006.01)

(52) U.S. Cl. ..... 604/317; 604/289; 604/385.01; 604/385.17; 604/385.21

(58) Field of Classification Search ..... 606/127, 606/161–162, 234–235; 604/289, 317, 385.01, 604/385.17, 385.21
See application file for complete search history.

(56) References Cited

U.S. PATENT DOCUMENTS

| | | | | |
|---|---|---|---|---|
| 2,157,802 | A * | 5/1939 | Rissinger | 604/278 |
| 5,715,559 | A * | 2/1998 | Mitri | 15/118 |
| 5,778,475 | A * | 7/1998 | Garcia | 15/111 |
| 5,984,935 | A * | 11/1999 | Welt et al. | 606/161 |
| D423,785 | S * | 5/2000 | Karallis | D4/108 |
| 7,311,688 | B2 | 12/2007 | Bichsel et al. | |
| 2002/0055723 | A1 | 5/2002 | Liu et al. | |
| 2005/0066465 | A1 | 3/2005 | Minkler et al. | |
| 2005/0187507 | A1 | 8/2005 | Reed et al. | |
| 2005/0197665 | A1 * | 9/2005 | Teed et al. | 606/161 |
| 2006/0264851 | A1 | 11/2006 | Coleman | |
| 2008/0208228 | A1 * | 8/2008 | Mueller | 606/161 |
| 2009/0062715 | A1 | 3/2009 | Saunders et al. | |

FOREIGN PATENT DOCUMENTS

GB 2104801 A * 3/1983

* cited by examiner

*Primary Examiner* — Melanie Hand
*Assistant Examiner* — Joshua Lee
(74) *Attorney, Agent, or Firm* — Nixon Peabody LLP; David F. Crosby

(57) ABSTRACT

A personal feminine hygiene device includes a curvilinear frame. The curvilinear frame can include a plurality of disk members disposed around and extending from the curvilinear frame, wherein the larger diameter or radius disks can be disposed around an approximate midpoint of the curvilinear frame, and wherein the diameter or radius of the disks gradually decreases moving from the midpoint to the terminal ends of the curvilinear frame. The device can further include a bowl-shaped member extending from one end of the curvilinear frame and can include a series of slats formed therein. The bowl-shaped member can further include a cap at its anterior end terminating at a convex shaped tip especially configured to access the crease adjacent to the cervix where debris, e.g., mucous, tends to pool, while the slats and the disks assist in removing and containing debris from the vaginal and cervical walls.

14 Claims, 5 Drawing Sheets

PERSONAL FEMININE HYGIENE DEVICE

CROSS-REFERENCE TO RELATED APPLICATIONS

This application claims the benefit under 35 U.S.C. §119 (e) and all benefits provided by law of U.S. Provisional Application No. 61/298,334 filed Jan. 26, 2010, which is hereby incorporated by reference in its entirety.

BACKGROUND TO THE INVENTION

1. Field of the Invention

This invention relates to a personal feminine hygiene device. More particularly, the invention relates to a device useful in removing debris from the vaginal and cervical walls.

2. Background of the Invention

Products offered to women in the area of vaginal cleansing are limited and primarily include disposable douches. Douches have been used to clean a woman's vaginal area after her menstrual cycle, to clean away contraceptive jellies or creams, after intercourse, or to wash away built up secretions that may cause odor. However, douches have been indicated to cause problems such as an increased tendency to develop yeast infections and alter the natural pH levels of vaginal tract. Currently, there are few or no useful alternatives to the douche that effectively assist a woman in the cleansing of her vaginal area.

SUMMARY OF THE INVENTION

In view of the foregoing, disclosed herein is a personal feminine hygiene device, which comprises a curvilinear frame. The device further comprises a plurality of disks disposed around the curvilinear frame, wherein the larger diameter or radius disks are disposed around an approximate or equal midpoint of the curvilinear frame, and wherein the diameter or radius of the disks gradually lessens moving from the approximate or equal midpoint to the terminal ends of the curvilinear frame. The device further comprises a bowl-shaped member coterminous with the curvilinear frame. The bowl-shaped member comprises a series of slats formed therein. The bowl-shaped member is further characterized by having a cap at its anterior end, wherein the cap terminates at a convex shaped tip. The tip is especially configured to allow for the increased collection of debris, and to access the crease adjacent to the cervix where debris, e.g., mucous, tends to pool, while the slats and the disks assist in removing and containing debris from the vaginal and cervical walls. The device further comprises a handle which is coterminous with the curvilinear frame and which provides a grip when the device is in use. Before explaining the various embodiments of the invention in detail, it is to be understood that the invention is not limited in its application to the details of construction and to the arrangements of the components set forth in the following description or illustrated in the drawings. Rather, the invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

For a better understanding of the invention, its operating advantages and the specific objects attained by its uses, reference should be made to the accompanying drawings and descriptive matter in which there are illustrated preferred embodiments of the invention.

DETAILED DESCRIPTION OF THE INVENTION

Figure 1:
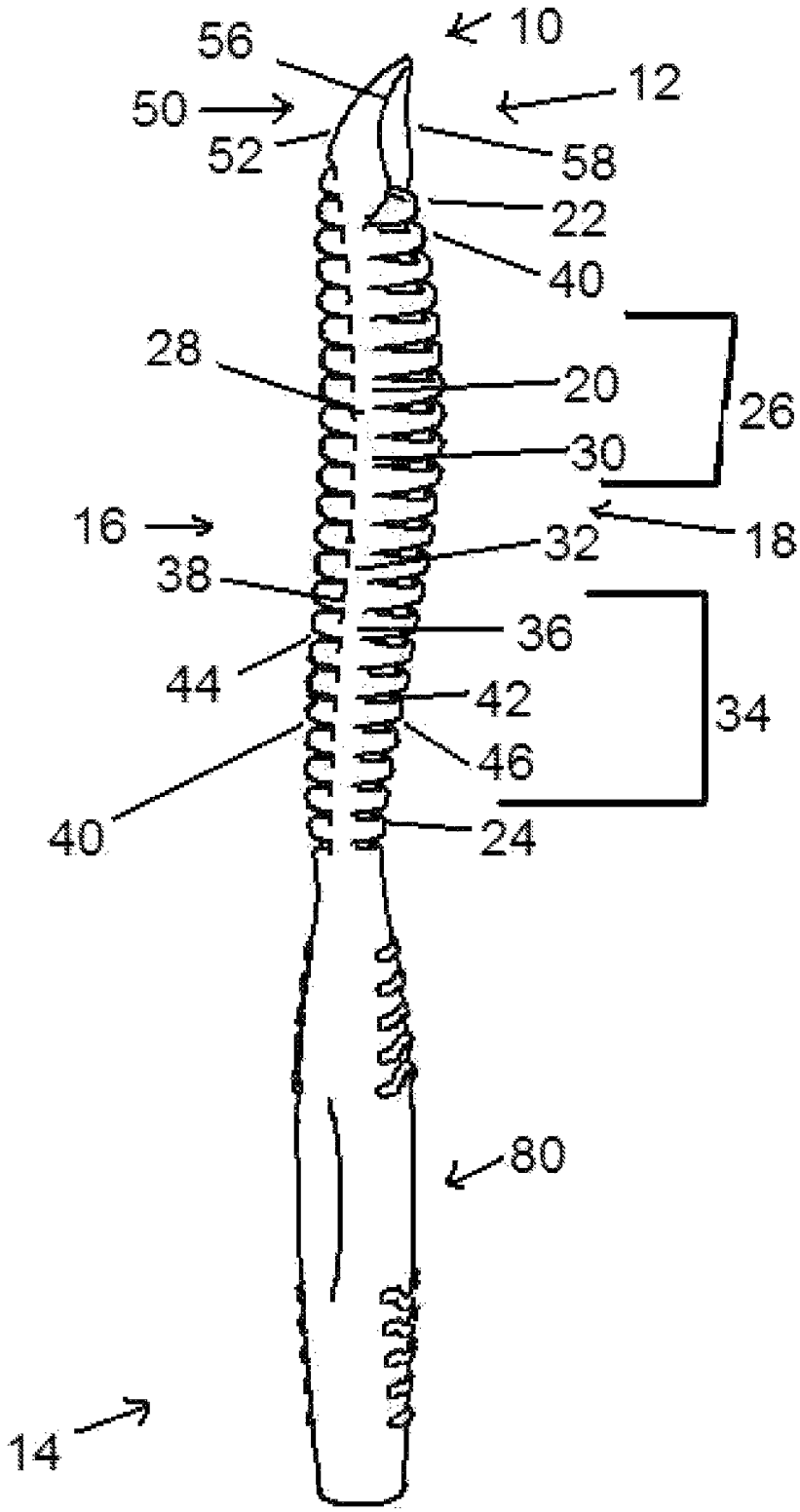
FIG. 1 shows a lateral side view of an exemplary feminine hygiene device in accordance with one embodiment of the invention.
Figure 2:
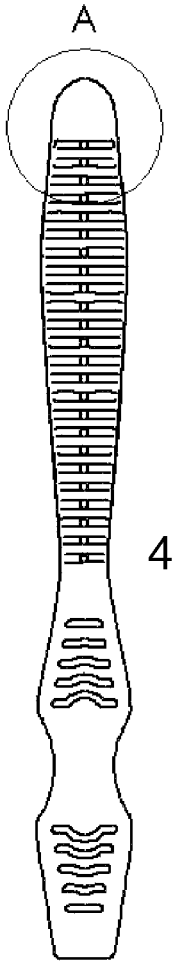
FIGS. 2 and 2A show a dorsal view of an exemplary bowl-shaped member in accordance with one embodiment of the invention.
Figure 2A:
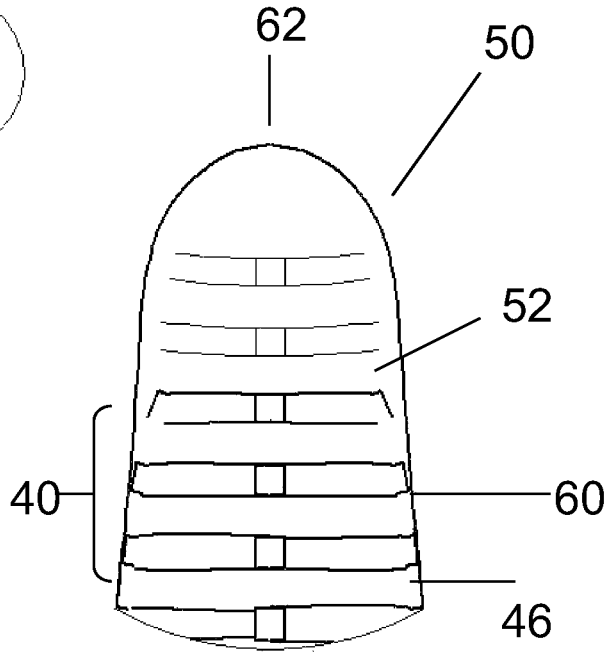
Figure 3:
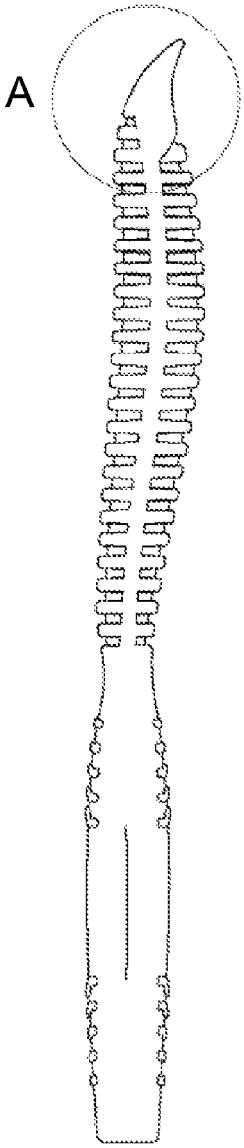
FIGS. 3 and 3A show a lateral view of the bowl-shaped member, in accordance with one embodiment of the invention, depicted in FIG. 2.
Figure 3A:
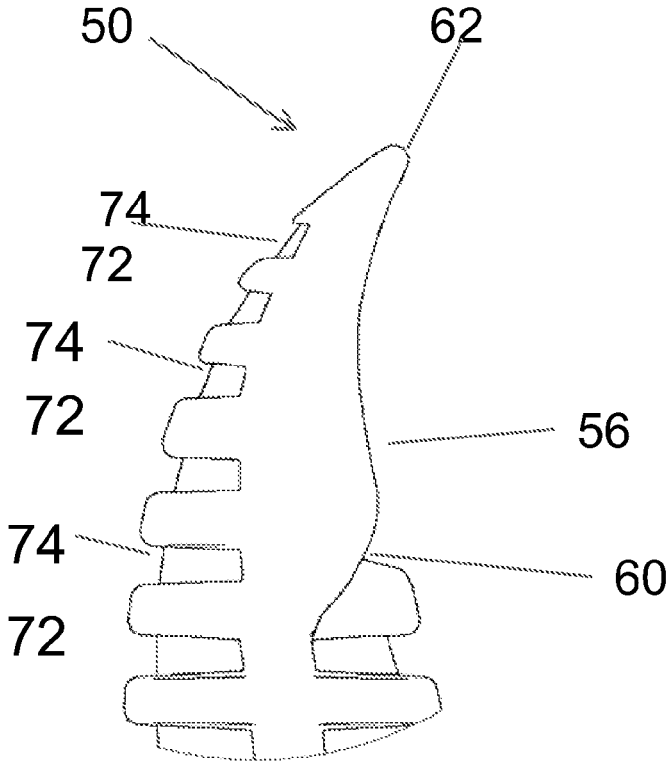

Disclosed herein is a personal feminine hygiene device configured for removing debris, e.g., mucous that discharges from the cervix, pools in the adjacent cervical creases and eventually migrates down the vaginal canal, from the cervical and vaginal walls. To that end, the personal feminine hygiene device is designed to accommodate the shape and integrity of a variety of shaped and sized vaginal walls which are at various phases of cyclical swelling.

The personal feminine hygiene device comprises a curvilinear frame. Although the curvilinear frame may be formed from a variety of materials, it is preferred that the material(s) be selected to confer a relative degree of flexibility to the device, and that it be safe for insertion within the vaginal tract. Exemplary materials include, for example, plastic, rubber, and the like.

Disposed around the curvilinear frame is a plurality of disks, wherein the disks are contoured, shaped, and positioned to effectively grip, capture, and direct debris from the vaginal and cervical walls. In an exemplary embodiment, each disk is spaced about ¼ inch from each immediately adjacent disk, and the plurality of disks comprises about 23 to about 25 disks, although more disks, for example, 40 or more, or less disks, for example, 20 or less, can be used in embodiments where the spacing between the disks is reduced or increased or the length of device is increased or reduced. The size of each disk can be measured according to its outside dimensions or diameter or according to the distance its outer edge extends from the curvilinear frame or radius. In accordance with one embodiment of the invention, the largest diameter or radius disks can be positioned around the midpoint of the curvilinear frame, and as the disks proceed from the midpoint to the terminal ends of the curvilinear frame, the diameters or radii of the disks gradually decrease in size. In accordance with one embodiment of the invention, the largest diameter disks can have a diameter of about ⅝ inch (5/16 radius), and the smallest diameter disks have a diameter of about ⅜ inch (3/16 radius). In alternative embodiments, the disks can be as large as ¾ inch or larger in diameter (⅜ inch or larger in radius) and as small as ¼ inch or smaller in diameter (⅛ inch or smaller in radius). Although the disks can be made of a variety of materials, preferably they are firm, yet sufficiently pliable, and safe for insertion within the vaginal tract. In some embodiments of the invention, the disks can be made from plastic, rubber, and the like. The disk and the device materials can be selected to be biologically compatible with the environment in which the device is used as well as compatible with chemical and thermal cleaning systems.

The device further comprises a bowl-shaped member joined at one end thereof to the curvilinear frame. In one embodiment of the invention, the bowl-shaped member can include a smooth, convex shaped. In alternative embodiments, the bowl-shaped member can include a convex shaped wall having formed therethrough a series of slats. In one embodiment, the slats can be grooved in a downward manner to more efficiently remove the debris as the device is pulled from the vaginal walls and towards the vaginal opening. The slats located towards the tip of the bowl-shaped member, i.e., located towards the anterior end of the bowl-shaped member, can be curved and shaped or adapted to capture and virtually wipe the vaginal side walls free of debris. The slats in the main body of the bowl-shaped member contain and grip the debris to accommodate more complete removal of the debris during removal of the device from the vaginal tract. Such slats also collect debris which may have already exited the cervical crease and begun to migrate down the vaginal canal.

The bowl-shaped member can further comprise a cap at its anterior end, which is characterized by an outwardly curved tip. This configuration is optimal as it not only guides the debris that emerges through the slats, but it also allows the bowl-shaped member to access the creases adjacent to the cervix. The bowl-shaped member may also be made from a variety of materials, wherein exemplary materials include, for example, rubber, plastic, and the like.

An exemplary personal feminine hygiene device now will be discussed with reference to the figures. However, it is noted that further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as embodiments. Elements and materials may be substituted for those illustrated and described herein, parts and processes may be reversed, and certain features of the invention may be utilized independently, all as would be apparent to one skilled in the art after having the benefit of this description of the invention.

Referring to FIGS. 1-4, an exemplary personal feminine hygiene device 10 can include an anterior portion 12 opposite to a posterior portion 14, and a dorsal side 16 opposite to a ventral side 18. Device 10 can include a curvilinear frame 20 which extends along a longitudinal axis, and can terminate at an anterior terminal end 22 located within anterior portion 12, and at a posterior terminal end 24 located within posterior portion 14 adjacent the handle 80.

In accordance with one embodiment of the invention, the curvilinear frame 20 can include a first curved portion 26, having a concave side 28 directed towards dorsal side 16 and an oppositely situated convex side 30 directed towards ventral side 18. The first curved portion 26 can terminate at anterior end 22 and at a point 32 at or close to a midpoint of curvilinear frame 20.

In accordance with one embodiment of the invention, the curvilinear frame 20 can further include a second curved portion 34, having a concave side 36 directed towards ventral side 18, and an oppositely situated convex side 38 directed 5 towards dorsal side 16. The second curve 34 can terminate at the posterior terminal end 24 and at point 32, which is at or close to the midpoint of curvilinear frame 20.

In accordance with one or more embodiments of the invention, positioned around curvilinear frame 20, and extending along a length thereof from anterior terminal end 22 to posterior terminal end 24, can be a plurality of disk-like members, disks 40, extending transverse to the length of curvilinear frame 20. In accordance with one embodiment of the invention, the curvilinear frame 20 can be formed from a flat strip and include a plurality of disks 40 extend from the front and back flat surface of the strip of the curvilinear frame 20. In one embodiment, the disks 40 include substantially semicircular elements having the flat side attached to one of the flat surfaces of the strip of the curvilinear frame 20. In some embodiments, the disks 40 extending from the ventral side 18 can be aligned with the disks 40 extending from the dorsal side 16. In other embodiments, the disks 40 extending from the ventral side 18 can be offset with respect to the disks 40 extending from the dorsal side 16. In addition, in some embodiments of the invention, the spacing between the disks 40 on the dorsal side 16 can be the same as the disks 40 on the ventral side 18. In alternative embodiments of the invention, the spacing between the disks 40 on the dorsal side 16 can be different from the spacing between the disks 40 on the ventral side 18. While the drawings show the disk-like members having a circular shape, the disk-like members can be round, oval, or any polygon shape, such as square or rectangular, including for example with corners rounded or chamfered. Further, the disk-like member can have multiple curved surfaces, e.g. scallop shaped.

The plurality of disks 40 can be arranged along the curvilinear frame 20 such that the diameter or radius of each disk gradually decreases starting at or approximate at central point 32 and moving towards anterior terminal end 22, and starting from central point 32 and moving towards posterior terminal end 24. Accordingly, the larger diameter or radius disks can be located within the middle region of curvilinear flame 20, and the smaller diameter or radius disks are located towards the anterior and posterior terminal ends of curvilinear frame 20. Alternatively, in some embodiments, the smaller diameter or radius disks 40 can be located in the middle region and the diameter or radius of the disks 40 can increase along the curvilinear frame 20 in the direction of the anterior terminal end 22 and/or the posterior terminal end 24. To remove an optimal amount of debris from the cervical and vaginal walls, in an exemplary embodiment, the top surface 42, the bottom surface 44, and the exterior annular edge 46 of each disc can be exposed.

In accordance with one embodiment of the invention, the personal feminine hygiene device 10 can further include a bowl-shaped member 50 at or adjacent to the anterior terminal end 22. Bowl-shaped member 50 can include a convex shaped wall 52 directed towards dorsal side 16, and which can be coterminous with anterior terminal end 22 of curvilinear frame 20. The convex shaped wall 52 can extend into lateral edges 56 and 58 which are exposed on ventral side 18 of device 10.

Figure 4:
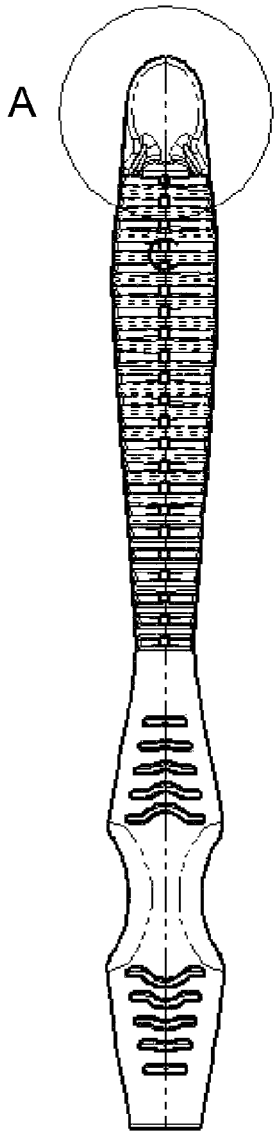
FIGS. 4 and 4A show a ventral view of the bowl-shaped member, in accordance with one embodiment of the invention, depicted in FIGS. 2 and 3.
Figure 4A:
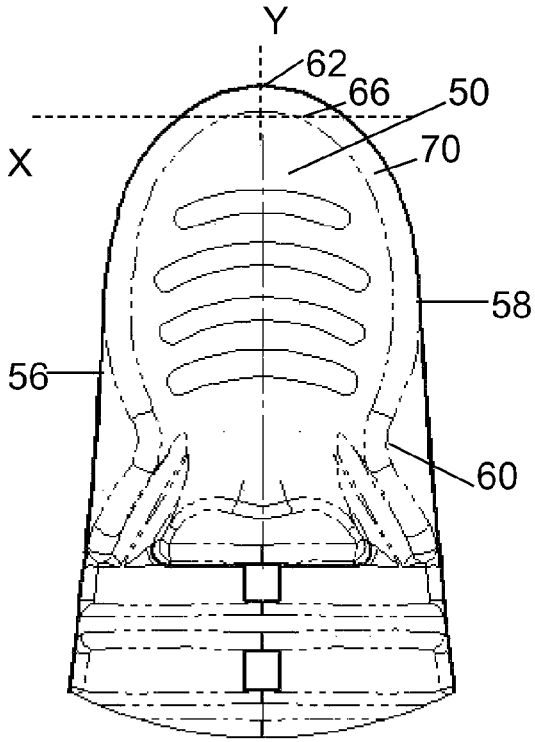

As shown in FIGS. 2-4A, lateral edge 56 and lateral edge 58 extend from a base 60 of convex shaped wall 52, towards an anterior end 62 of convex shaped wall 52. In some embodiments of the invention, the anterior end 62 can curved forming the perimeter of the bowl of the bowl-shaped member 50. In some embodiments of the invention, as shown in FIG. 4A, the bowl of the bowl-shaped member 50 can further include protruding ridges to facilitate the collection of debris. In other embodiments of the invention, the bowl of the bowl-shaped member 50 can further include grooves to facilitate the collection of debris.

In alternative embodiments of the invention, at a common axis X and directed towards ventral side 18, each of lateral edges 56 and 58 can slope downward towards base 60 until the two lateral edges 56 and 58 converge at a tip, thereby forming a cap having a concave interior portion opposite to a convex exterior portion 70. Configured in this manner, the cap can serve as a scooping mechanism whereby debris can be scooped away from the cervical and vaginal walls. The cap can further assist in capturing an optimal amount of debris, and is designed to access the crease adjacent to the cervix.

In an alternative embodiment, the convex shaped wall 52 can include a series of slats 72, wherein each slat is centrally positioned along a longitudinal axis Y which bisects convex shaped wall 52, and wherein each slat is bowed upwards towards tip 64. Each slat is formed by forming a slot 74 through convex shaped wall 52.

In accordance with various embodiments of the invention, the personal feminine hygiene device 10 can further include a handle 80 coterminous with posterior terminal end 24 of curvilinear frame 20. Handle 80 can include a stop (not shown), which is preferably located on a portion of handle 80 near posterior terminal end 24. The stop can be configured to prevent that portion of handle 80 which is posterior to the stop from entering the vaginal tract. Handle 80 can be contoured and shaped to provide for a secure, yet comfortable grip of device 10 when device 10 is in use, i.e., when bowl-shaped member 50, curvilinear frame 20, and plurality of disks 40 are inserted within the vaginal tract, and used to collect and remove debris from the vaginal and cervical walls. Further, the handle 80 can be irregularly shaped or asymmetrical along its longitudinal axis in order to enable the user to determine the orientation of bowl-shaped member 50, curvilinear frame 20, and plurality of disks 40 when inserted within the vaginal tract.

Figure 5:
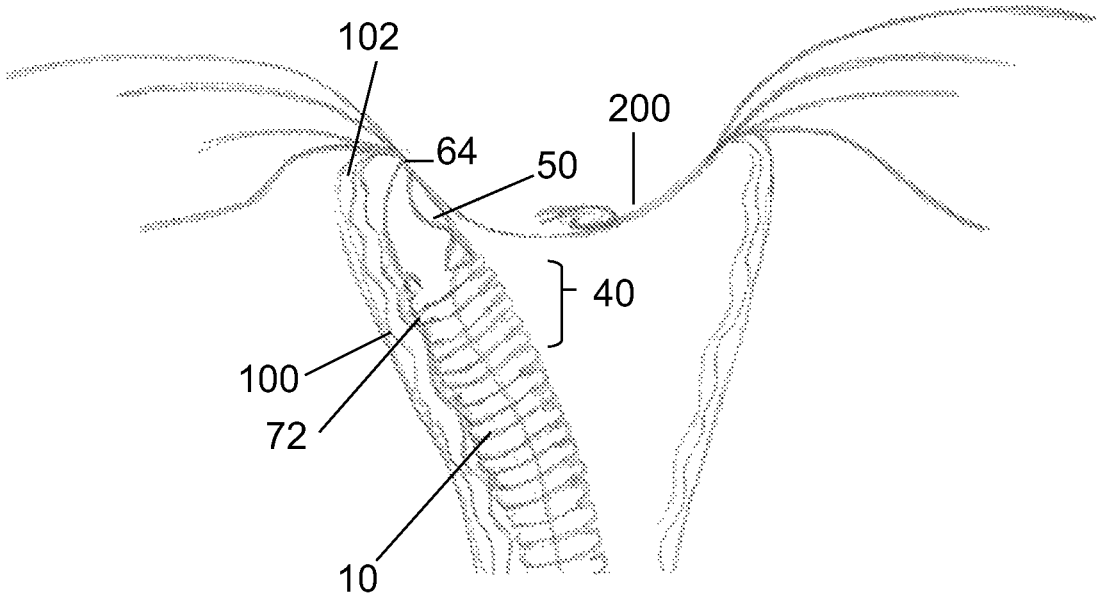
FIG. 5 shows a diagrammatic view of an exemplary application of an embodiment of the invention.

An exemplary application of personal feminine hygiene device 10 is depicted in FIG. 5. FIG. 5 depicts personal feminine hygiene device 10 scraping debris from a vaginal wall 100. Device 10 can be inserted through the vaginal tract by holding handle 80 and pushing device 10 through the vaginal tract. At least some of the plurality of disks 40 may be disposed on the vaginal wall, and handle 80 may be rotated and/or moved up and down such that the disks effectively scrape away and retain debris contained on the vaginal walls. Optionally, the slats 72 on bowl-shaped member 50 can be used to catch and remove debris from the vaginal walls. Tip 64 of the bowl-shaped member is also depicted accessing a crease 102 adjacent to cervix 200 where debris commonly collects.

Thus there has been described a novel and useful device for removing debris from the vaginal and cervical walls in a safe, effective, and comfortable manner that has yet been here before unknown.

What is claimed is:

1. A feminine hygiene device for insertion into a vagina for removing debris from the vaginal wall, the device comprising a curvilinear frame extending in a longitudinal direction from an anterior end to a posterior end, the curvilinear frame including a dorsal side and a ventral side;

the curvilinear frame including a first curved portion adjacent the anterior end, the first curved portion including a convex portion on the ventral side and a concave portion on the dorsal side;

the curvilinear frame including a second curved portion adjacent the posterior end, the second curved portion including a concave portion on the ventral side and a convex portion on the dorsal side;

a plurality of disk members extending from the curvilinear frame in a direction transverse to the longitudinal direction at least along the first curved portion for collecting debris from the vaginal wall;

a bowl-shaped member extending from the anterior end, the bowl-shaped member including a convex surface aligned with the dorsal side of the curvilinear frame and a concave surface aligned with the ventral side of the curvilinear frame; and a handle extending from the posterior end.

2. The feminine hygiene device of claim 1 wherein the bowl-shaped member includes a first lateral edge and a second lateral edge and the first lateral edge and the second lateral edge extend from the anterior end of the curvilinear frame to a tip defining the concave surface.

3. The feminine hygiene device of claim 1 wherein the plurality of disk members extend from the dorsal side of the curvilinear frame.

4. The feminine hygiene device of claim 3 wherein at least two of the plurality of disk member have different radii.

5. The feminine hygiene device of claim 3 wherein each of the plurality of disk members has a radius and the radius of at least one disk member located in a central portion of the curvilinear frame is larger than at least one disk member located adjacent to the anterior end of the curvilinear frame.

6. The feminine hygiene device of claim 3 wherein each of the plurality of disk members has a radius and the radius of at least one disk member located in a central portion of the curvilinear frame is smaller than at least one disk member located adjacent to the anterior end of the curvilinear frame.

7. The feminine hygiene device of claim 3 wherein each of the plurality of disk members has a radius and the radius of at least one disk member located in a central portion of the curvilinear frame is larger than at least one disk member located adjacent to the posterior end of the curvilinear frame.

8. The feminine hygiene device of claim 3 wherein each of the plurality of disk members has a radius and the radius of at least one disk member located in a central portion of the curvilinear frame is smaller than at least one disk member located adjacent to the posterior end of the curvilinear frame.

9. The feminine hygiene device of claim 1 wherein the plurality of disk members extend from the ventral side of the curvilinear frame.

10. The personal feminine hygiene device of claim 9 wherein at least two of the plurality of disk member have different radii.

11. The feminine hygiene device of claim 9 wherein each of the plurality of disk members has a radius and the radius of at least one disk member located in a central portion of the curvilinear frame is larger than at least one disk member located adjacent to the anterior end of the curvilinear frame.

12. The feminine hygiene device of claim 9 wherein each of the plurality of disk members has a radius and the radius of at least one disk member located in a central portion of the curvilinear frame is smaller than at least one disk member located adjacent to the anterior end of the curvilinear frame.

13. The feminine hygiene device of claim 9 wherein each of the plurality of disk members has a radius and the radius of at least one disk member located in a central portion of the curvilinear frame is larger than at least one disk member located adjacent to the posterior end of the curvilinear frame.

14. The feminine hygiene device of claim 9 wherein each of the plurality of disk members has a radius and the radius of at least one disk member located in a central portion of the curvilinear frame is smaller than at least one disk member located adjacent to the posterior end of the curvilinear frame.

* * * * *